United States Patent [19]

Gofuku et al.

[11] Patent Number: 5,059,941

[45] Date of Patent: Oct. 22, 1991

[54] ELECTRODE STRUCTURE FOR A THICK FILM RESISTOR

[75] Inventors: Eishi Gofuku; Mitsuyuki Takada, both of Amagasaki, Japan

[73] Assignee: Mitsubishi Denki Kabushiki Kaisha, Tokyo, Japan

[21] Appl. No.: 584,602

[22] Filed: Sep. 19, 1990

[30] Foreign Application Priority Data

Sep. 19, 1989 [JP] Japan ..... 1-243003

[51] Int. Cl.[5] ..... H01C 1/012

[52] U.S. Cl. ..... 338/307; 338/308; 338/309; 338/314; 338/313; 427/103; 427/126.5; 428/931; 428/442

[58] Field of Search ..... 338/306, 307, 308, 309, 338/312, 314, 313; 427/98, 101, 102, 103, 126.2, 126.5; 428/426, 427, 931

[56] References Cited

U.S. PATENT DOCUMENTS 4,695,504 9/1987 Watanabe et al. ..... 338/308 X
4,732,802 3/1988 Bosze et al. ..... 338/312 X
4,751,492 6/1988 Tsuzuki et al. ..... 338/309 X
4,792,781 12/1988 Takahashi et al. ..... 338/307
4,961,999 10/1990 Hormaldaly ..... 428/427
4,963,389 10/1990 Takada et al. ..... 427/98

OTHER PUBLICATIONS

J. Appl. Phys., vol. 48, No. 12, Dec. 1977, Electrical Properties and Conduction Mechanisms of Ru-based Thick-film (Cermet) Resistors, G. E. Pike and C. H. Seager, pp. 5152-5269.

*Primary Examiner*—Marvin M. Lateef
*Attorney, Agent, or Firm*—Oblon, Spivak, McClelland, Maier & Neustadt

[57] ABSTRACT

A resistor device includes a thick-film resistor which includes a mixture of electrical conductive material and glass, and which has the electrical conductive material at a surface portion exposed; and electrodes which are deposited on the thick-film resistor to be connected to the exposed electrical conductive material.

2 Claims, 5 Drawing Sheets

ELECTRODE STRUCTURE FOR A THICK FILM RESISTOR

BACKGROUND OF THE INVENTION

1. FIELD OF THE INVENTION

The present invention relates to a resistor device which can be used in an electric circuit.

2. DISCUSSION OF BACKGROUND

FIG. 4 is a cross sectional view showing the structure of a conventional resistor device, which has been disclosed in e.g. the article of J. APPL. Phys. Vol. 48, No. 12 p. 5161. In FIG. 4, reference numeral 1 represents particles of ruthenium oxide ($RuO_2$). Reference numeral 2 represents lead borosilicate glass. Reference numeral 3 represents particles of alloy comprising silver (Ag) and palladium (Pd). Reference numeral 4 represents lead borosilicate glass. Reference numeral 5 represents an alumina ceramic substrate. Reference numeral 6 represents a thick-film resistor which comprises the $RuO_2$ particles 1 and the lead borosilicate glass 2. Reference numeral 7 represents thick-film conductors which comprise the particles 3 of alloy comprising silver (Ag) and palladium (Pd), and the lead borosilicate glass 4.

The conventional resistor device is obtained by depositing by screen printing paste including the alloy particles 3 and the glass 4, and paste including the $RuO_2$ particles 1 and the glass 2 on the alumina ceramic substrate 5 and firing them. The thick-film conductors 7 and the thick-film resistor 6 differ from each other in the dispersion state of conductive particles. The alloy particles 3 as conductive particles are in touch with one another to form a conductive network in the thick-film conductors 7, whereas the $RuO_2$ particles 1 as conductive particles disperses without being in touch with one another in the thick-film resistor 6. In the firing step of the thick-film resistor, the $RuO_2$ particles 1 diffuses into the glass 2 in small amounts. As a result, the glass 2 which is inherently an insulator gains conduction to become a semiconductor having high resistance. The resistance of the thick-film resistor 6 is expressed as the sum of the resistance of the $RuO_2$ particles and that of the glass. The $RuO_2$ particles act like metal in terms of electronic energy though the $RuO_2$ particles are metal oxide. It means that the $RuO_2$ particles have a wide range of electronic energy band, and that the particles are oxide having high level of electron density. The glass 2 is melted to cause the $RuO_2$ particles to flow in the firing step, thereby giving to the electrode portions of the conventional resistor portion a microstructure wherein the $RuO_2$ particles and the Pd/Ag alloy particles are directly in touch with one another. In this way, electrodes are formed on the thick-film resistor 6 in the form of contact of metal to metal.

Because the thick-film conductors are deposited by screen printing, there are limitations imposed on the dimensions of the films prepared in this manner. It is in practice difficult to deposit wiring having a width of 150 μm or less. For these reasons, attempts have been made to use a thin film of metal as wiring, thereby obtaining minute wiring. FIG. 5 shows a conventional resistor device in section wherein thin film conductors of copper are formed on a thick-film resistor. In FIG. 5, reference numeral 1 represents $RuO_2$ particles. Reference numeral 2 represents lead borosilicate glass. Reference numeral 5 represents an alumina ceramic substrate. Reference numeral 6 represents a thick-film resistor which comprises the $RuO_2$ particles 1 and the lead borosilicate glass 2. Reference numeral 8 represents the thin film conductors of copper, which are deposited by chemical copper plating in the case of FIG. 5. Reference numeral 9 represents an activation layer which is predominantly lead borosilicate glass, palladium oxide being added to it in small amounts. The surface of the thick-film resistor is coated by glass having a thickness of 0.1 μm or less. This surface glass is a semiconductor having a high level of resistance as stated earlier.

Since the thick-film resistors of the conventional resistor devices are constructed as described above, the electrodes of the resistor devices have the microstructure wherein the semiconductor glass and the copper are directly in touch with each other. It means that the presence of contact of semiconductor to metal produces a barrier in the energy state of the electrons at the contacting portions. A change in connection resistance has a significant effect on the resistance of the thick-film resistor, and the resistance of the thick-film resistor will change with time.

SUMMARY OF THE INVENTION

It is an object of the present invention to solve the problem of the conventional resistor devices, and provide a resistor device wherein the resistance is prevented from changing with time.

The foregoing and other objects of the present invention have been attained by providing a resistor device including a thick-film resistor which comprises a mixture of electrical conductive material and glass, and which has the electrical conduct material at a surface portion exposed; and electrodes which are deposited on the thick-film resistor to be connected to the exposed electrical conductive material.

The resistor can be a composite resistor which comprises a mixture of electrical conductive material and material having greater resistivity than the electrical conductive material.

In the structure of the electrode portions according to the present invention, the contact of metal to metal is formed. As a result, the connection resistance is stable, and the resistance of the thick-film resistor is prevented from changing with time.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
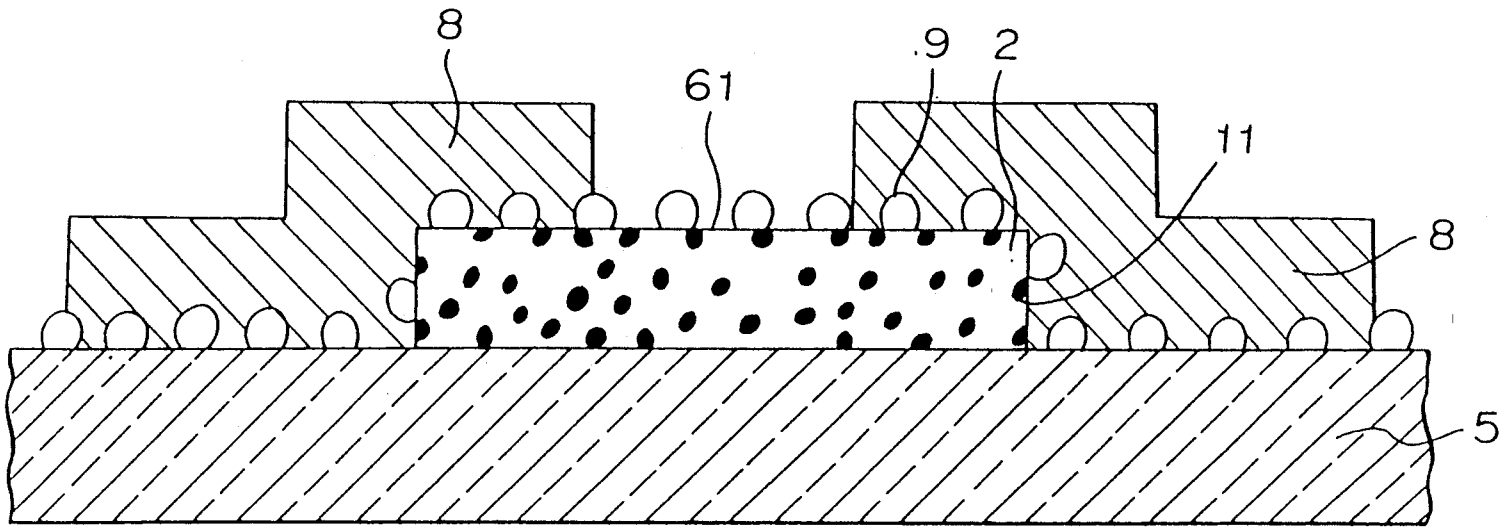
FIG. 1 is a cross sectional view showing an embodiment of resistor device according to the present invention.
Figures 2A, 2B, 2C, 2D, 2E:
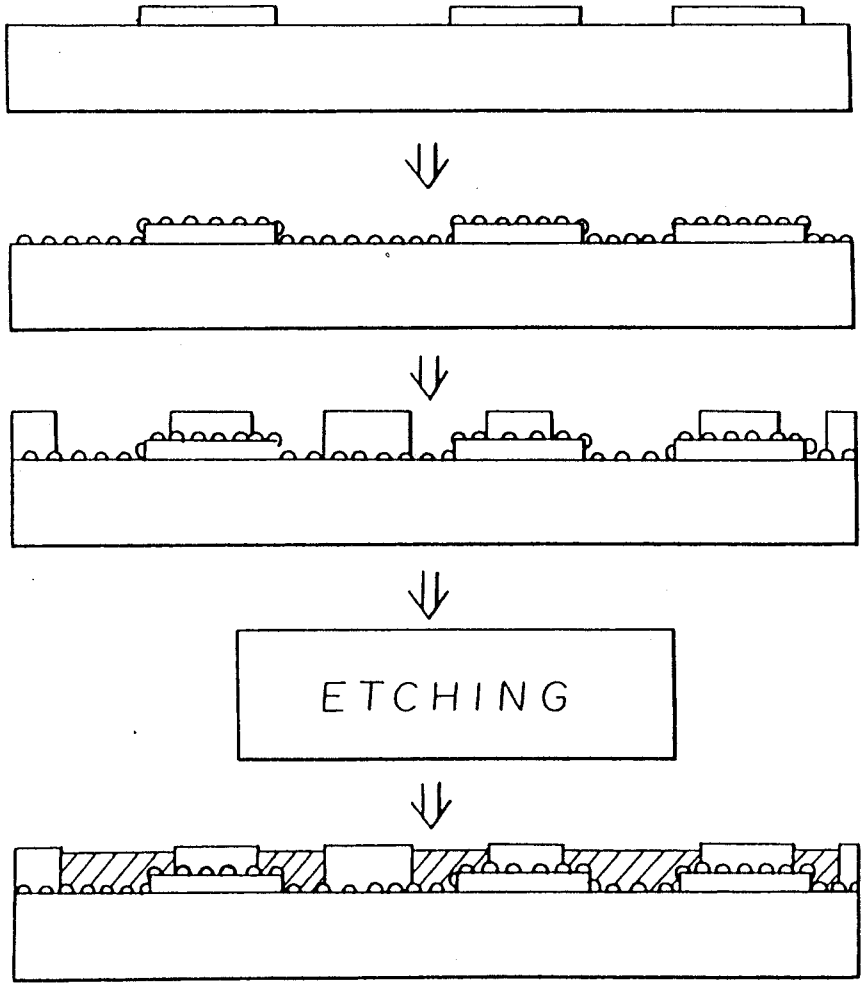
FIGS. 2A–2E are schematic diagrams showing the steps in fabrication of the embodiment.
Figures 3A, 3B, 3C, 3D, 3E:
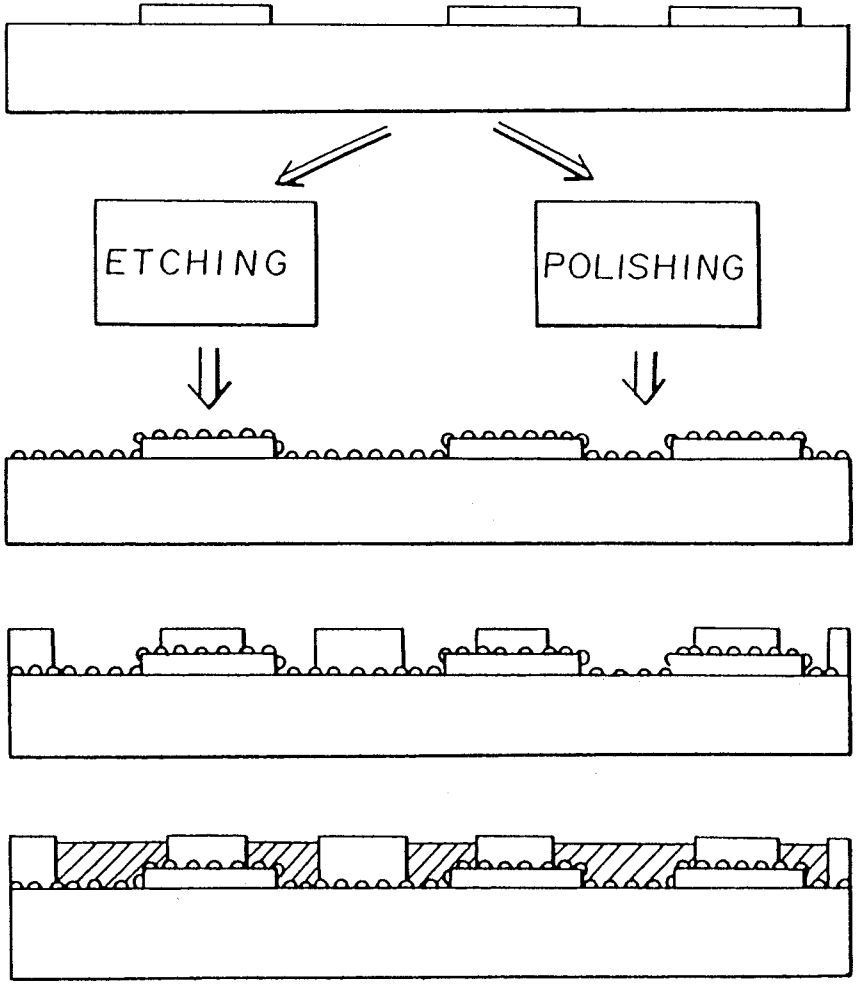
FIGS. 3A–3E are schematic diagrams showing the steps in different fabrication of the embodiment.
Figure 4:
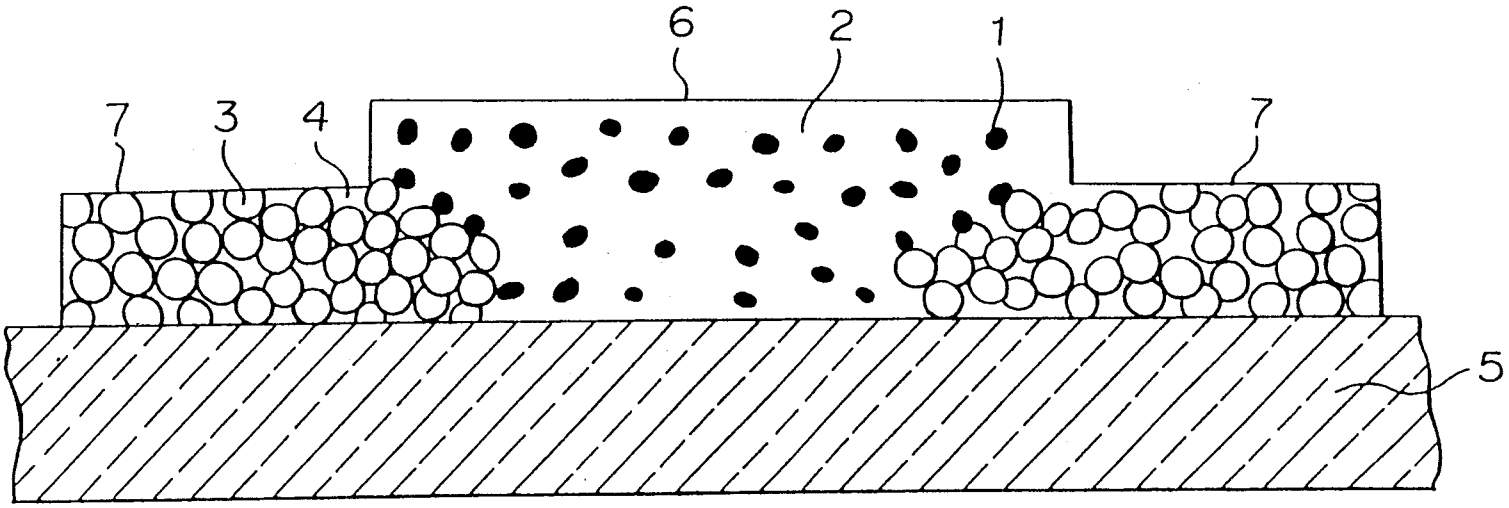
FIG. 4 is a cross sectional view showing the conventional resistor device.

FIG. 1 is a cross sectional view showing an embodiment of the resistor device according to the present invention. In FIG. 1, reference numeral 11 represents $RuO_2$ particles. Reference numeral 2 represents lead borosilicate glass. Reference numeral 5 represents an alumina ceramic substrate. Reference numeral 61 represents a thick-film resistor which comprises the $RuO_2$ particles 11 and the lead borosilicate glass 2, and which is deposited on the alumina ceramic substrate 5. Reference numeral 8 represents thin film conductors of copper, which are deposited on the alumina ceramic substrate 5 and the thick-film resistor 61 by chemical copper plating to be used as electrodes. Reference numeral 9 represents an activation layer which is deposited on the thick-film resistor 61 and the lead borosilicate substrate 5, and which is dominantly lead borosilicate glass, palladium oxide being added to it in small amounts. The activation layer is of electrically insulating material, and porous glass which has a catalytic function for the deposition of the thin film conductors.

Figure 5:
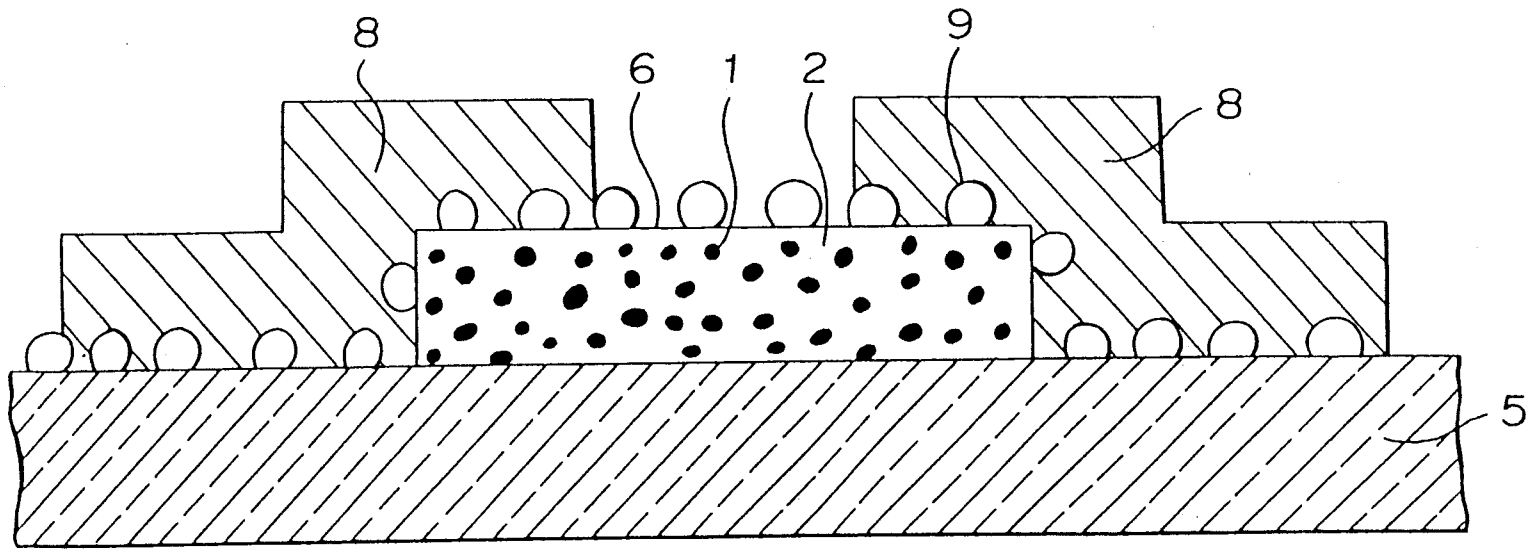
FIG. 5 is a cross sectional view showing the other conventional resistor device.

The thick-film resistor 6 of the conventional resistor device has the conductors 8 in touch with the glass 2 (see FIG. 5). On the other hand, the thick-film resistor 61 of the embodiment of the resistor device according to the present invention has the electrodes 8 in touch with not only the glass 2 and but also the $RuO_2$ particles 11. Because the $RuO_2$ particles have electrical conductivity as stated earlier, the contact resistance between the thick-film resistor 61 and the electrodes 8 in the embodiment is small, and a variation in the contact resistance is minimized in comparison with the contact resistance through the glass as a semiconductor having a high level resistance in the conventional resistor device. For these reasons, the variation in resistance of the resistor device of the embodiment can be restained in an extremely good manner.

Now, an example of the fabrication process for the embodiment of the resistor device according to the present invention will be described with reference to FIGS. 2A–2E.

(A) Paste for the thick-film resistor is printed on an alumina ceramic substrate, and fired at 850° C. to form a thick-film resistor (resistor formation).

(B) Activation paste is printed on the substrate and the resistor, and fired at 650° C. to form a porous activation layer (activation layer formation).

(C) A resist is deposited on the activation layer by a photoengraving process. In this example, the resist is of polyimide (resist formation).

(D) An aqueous mixed solution of hydrofluoric acid and nitric acid is used to etch a glass portion located at the surface of the thick-film resistor, thereby exposing the $RuO_2$ particles (electrical conductive material exposure).

(E) The substrate is dipped in a chemical plating solution to deposit metallic coating in windows in the resist, thereby forming thin film conductors. In this example, chemical copper plating is utilized (chemical plating).

By the fabrication process, the thin film conductors as electrodes are deposited on the thick-film resistor to obtain a structure wherein the electrodes are connected to the exposed $RuO_2$ particles which are electrical conductive material.

Although in the fabrication process as explained above the glass portion at the surface of the thick-film resistor is removed after formation of the resist, the glass portion may be removed after formation of the thick-film resistor as shown in FIGS. 3A–3E wherein another example of the fabrication process of the resistor device according to the present invention is shown. As for the method for exposing the electrical conductive materials in the resistor, mechanical polishing or grinding, besides the chemical etching as stated earlier, can be utilized to offer similar effect. Heat source having a high level of energy density such as laser, electron-beam and ion-beam, which has an etching function, is also applicable provided that the kind of the heat source and conditions are suitably set.

Although in the embodiment the thick-film resistor comprising the $RuO_2$ particles and glass is used as the electrical conductive material, the thick-film resistor can be constituted by $Bi_2Ru_2O_7$ particles as the electrical conductive material, and the same glass as the embodiment or a polymer.

Although the explanation on the embodiment has been made for the case of the resistor device using the thick-film resistor, the present invention is also applicable to e.g. a thick-film resistor or a composite resistor such as a varistor, wherein a mixture of e.g. a metal, a metal compound or other electrical conductive material, and material having greater resistivity than the electrical conductive material has the electrical conductive material exposed at the surface portion. The varistor is a composite resistor which is constituted by SiC, NiO, ZnO or C as the electrical conductive materials, and inorganic material such as glass or organic material such as polymer as material having greater resistivity than the electrical conductive materials.

The electrodes in the resistor device according to the present invention can be obtained by other thin film formation methods such as sputtering, chemical vapor deposition (CVD) besides the thin film formation involving plating the thick-film resistor and the composite resistor. In the embodiment, the use of the plating technique to form the thin film conductors requires the presence of the activation layer. However, the presence of the activation layer is not essential to the present invention. In the other thick-film formations, the activation layer can be omitted, or other structure can be adopted.

Obviously, numerous modifications and variations of the present invention are possible in light of the above teachings. It is therefore to be understood that within the scope of the appended claims, the invention may be practiced otherwise than as specifically described herein.

What is claimed is:

1. A resistor device, comprising:

a substrate, a thick film resistor upon said substrate, said thick film resistor including minute conducting $RuO_2$ particles dispersed in and partially diffused into lead borosilicate glass, whereby said glass is semiconducting, surface portions of said thick film resistor being acid-etched surface portions with conducting $RuO_2$ exposed on said surface portions;

thin film electrodes on said surface portions, providing a contact resistance between said electrodes and said surface portions which is much lower than the resistance of said device, whereby said contact resistance remains unchanged.

2. A resistor device, comprising:

a composite resistor consisting essentially of a mixture of electrically conducting material dispersed in a semiconducting glass;

surface portions of said composite resistor being acid-etched surface portions with said electrically conducting material exposed on said surface portions; and electrodes deposited on said surface portions providing a contact resistance which is much lower than the resistance of said device, whereby said contact resistance remains unchanged.

* * * * *